US006905305B2

(12) United States Patent
James

(10) Patent No.: US 6,905,305 B2
(45) Date of Patent: Jun. 14, 2005

(54) ENGINE CASING WITH SLOTS AND ABRADABLE LINING

(75) Inventor: Malcolm R James, Bristol (GB)

(73) Assignee: Rolls-Royce plc, London (DE)

( * ) Notice: Subject to any disclaimer, the term of this patent is extended or adjusted under 35 U.S.C. 154(b) by 0 days.

(21) Appl. No.: 10/358,891

(22) Filed: Feb. 6, 2003

(65) Prior Publication Data

US 2003/0152455 A1 Aug. 14, 2003

(30) Foreign Application Priority Data

Feb. 14, 2002 (GB) ..... 0203503

(51) Int. Cl.[7] ..... F01D 11/12
(52) U.S. Cl. ..... 415/173.4; 415/57.4; 415/119
(58) Field of Search ..... 415/173.4, 173.5, 415/9, 119, 57.1, 57.4, 58.5, 59.7

(56) References Cited

U.S. PATENT DOCUMENTS 3,542,152 A * 11/1970 Adamson et al. ..... 415/119
3,843,278 A * 10/1974 Torell ..... 415/173.4
3,890,060 A * 6/1975 Lipstein ..... 415/119
4,460,185 A * 7/1984 Grandey ..... 415/173.4
4,867,639 A 9/1989 Strangman
5,137,419 A 8/1992 Waterman
5,520,508 A * 5/1996 Khalid ..... 415/119
5,607,284 A * 3/1997 Byrne et al. ..... 415/58.5
5,628,622 A * 5/1997 Thore et al. ..... 415/173.1
6,203,021 B1 3/2001 Wolfla
6,352,264 B1 * 3/2002 Dalzell et al. ..... 415/173.4

FOREIGN PATENT DOCUMENTS

WO WO 95/34745 A 12/1995

* cited by examiner

*Primary Examiner*—Christopher Verdier
(74) *Attorney, Agent, or Firm*—W. Warren Taltavull; Manelli Denison & Selter PLLC

(57) ABSTRACT

An engine casing (16) encloses a rotor (15) and has a wall the inner surface (17) of which has slots (20) therein. An abradable lining (19) is attached to the inner surface (17) of the wall and extends across the slots (20). The abradable lining (19) is fluid permeable so that in operation a fluid passes through the lining (19) and recirculates in the slots (20). Recirculation of the fluid within the slots (20) increases the aerodynamic efficiency of the rotor (15).

8 Claims, 1 Drawing Sheet

ENGINE CASING WITH SLOTS AND ABRADABLE LINING

The present invention relates to an engine casing provided with slots and an abradable lining. The casing is particularly suitable for use in the compressor section of a gas turbine engine.

The aerodynamic design of an aero-engine is optimised for a particular working line, typically the cruise condition. During starting or other manoeuvres the aerodynamics can become unstable. To improve the stability of the aerodynamics away from the working line casing treatments are used.

Various treatments are available and include the provision of slots of varying depths and forms in the inner surface of the casing. The slots are put in the casing above the blade tips to allow recirculation of the air.

A problem with slotted casings is the inclusion of an abradable rotor path lining. Abradable linings are used on rotor casings to provide the tightest tip clearance whilst accommodating radial growth of the blades. Abradable linings are however easily damaged when slotted and difficulties occur in applying them to a slotted casing. Abradable linings are therefore rarely incorporated onto slotted casings and so an increase in the tip clearance is then required to compensate.

The present invention seeks to provide an abradable lining on a slotted casing, which overcomes the aforementioned problems.

According to the present invention an engine casing encloses a rotor, the casing comprises a wall having an inner surface adjacent the rotor, at least a portion of the inner surface of the wall has at least one slot therein, an abradable lining is attached to the inner surface of the wall, the abradable lining is fluid permeable and extends across the slot.

The casing may be provided with a plurality of slots equi-spaced circumferentially in the inner surface of the wall. The slots may be radially inclined and the radial depth of the slots may vary.

Preferably the abradable lining is a cellular structure and is attached to the slotted casing by adhesive. Regions of the cellular structure between the slots may be blocked to prevent the passage of the fluid therethrough. The regions of the cellular structure between the slots may be blocked by adhesive.

The present invention will now be described with reference to the accompanying figures in which.

Figure 1:
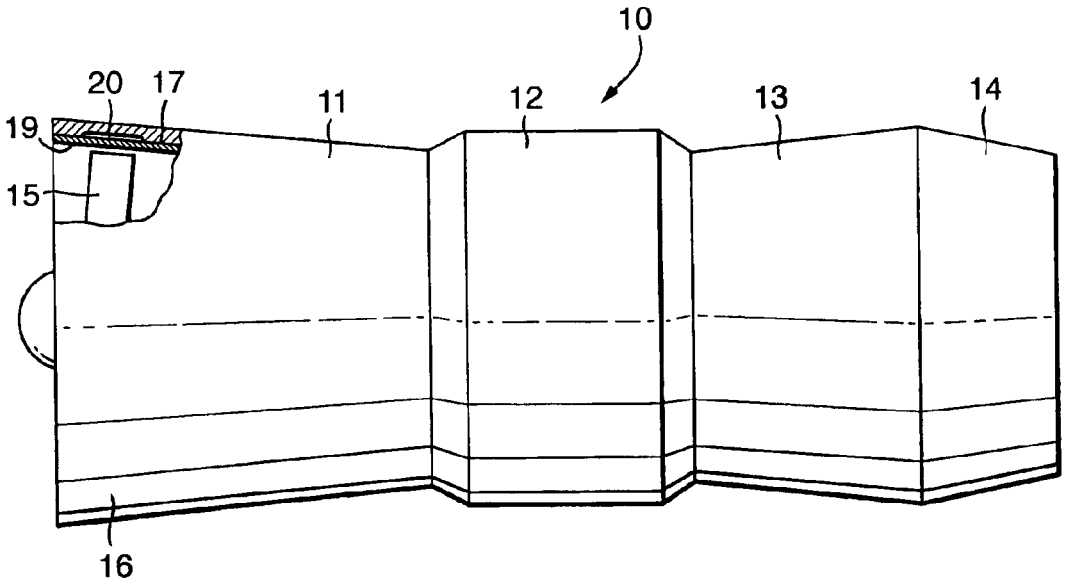
FIG. 1 is a partially sectioned side view of a gas turbine engine having a casing in accordance with the present invention.
Figure 2:
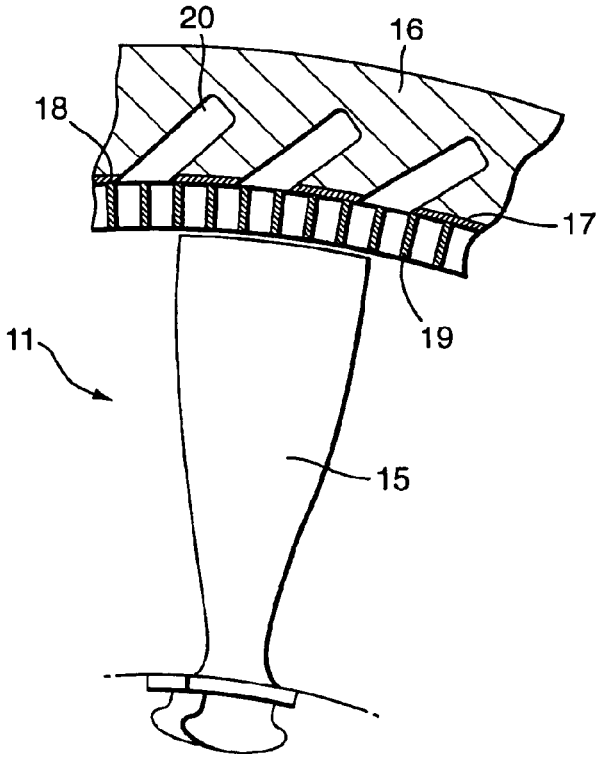
FIG. 2 is a partially sectioned view of part of the compressor shown in FIG. 1.

Referring to FIG. 1, a gas turbine engine generally indicated at 10 comprises in axial flow series a compressor 11, combustion equipment 12, a turbine 13 drivingly connected to the compressor 11 and an exhaust nozzle 14. The engine functions in conventional manner, that is a fluid, such as air, enters the compressor 11 and is compressed by alternate rows of rotor blades 15 and stator vanes (not shown). The compressed air is mixed with fuel and combusted in the combustor 12. The combustion products drive the turbine 13 before being exhausted to atmosphere through the exhaust nozzle 14.

To improve the aerodynamic performance of the compressor 11, an abradable lining 19 is provided on the inner wall 17 of the compressor casing 16 adjacent the tips of the rotor blades 15. The lining 19 reduces the clearance between the tips of the rotor blades 15 and the wall 17 and is abradable to accommodate radial growth of the blades 15.

The lining 19 is fluid permeable and extends across a plurality of discrete angled slots 20 which are machined into the inner wall 17 of the compressor casing 16. The angled slots 20 are equi-spaced around the circumference of the inner wall 17 and have a uniform radial depth. Whilst a number of discrete slots 20 are shown it will be appreciated that a single circumferential slot could be used. The radial depth of the slots 20 could also be varied.

The lining 19 is attached to the inner wall 17 of the casing 16 by adhesive 18. The lining 19 has a cellular construction, which allows the passage of air therethrough. In the regions where the lining 19 extends across the slots 20, air passes through the cells into the slot 20 where it recirculates. In the regions between the slots 20 air passes through the cells and is blocked by the inner wall 17 of the casing 16. These cells become pressurised preventing little recirculation or turbulence.

In the regions between the slots 20 adhesive 18 blocks some of the cells in the lining 19. The blocked cells further reduce the recirculation or turbulence in the lined regions between the slots 20.

The use of a fluid permeable lining 19 allows the slots 20 in the casing 16 to be exposed to the air stream. The air recirculates within the slots 20 as usual.

As the lining 19 is fluid permeable there is no need to machine further slots into the lining 19 and the integrity of the lining 19 is maintained.

During repair and overhaul the entire lining 19 is removed and replaced. As the lining 19 extends over the slots 20, the difficulties that have previously been encountered in applying the abradable lining 19 only to those regions between the slots 20 are avoided.

I claim:

1. An engine casing enclosing a rotor, the casing comprising a wall having an inner surface adjacent the rotor, at least a portion of the inner surface of the wall having at least one slot therein, the at least one slot being located radially outward of the inner surface of the wall, an abradable lining being attached to the inner surface of the wall, the abradable lining being located radially inside of the inner surface of the wall, the abradable lining being fluid permeable and extending over the slot.

2. An engine casing as claimed in claim 1 in which the abradable lining is attached to the inner surface of the wall by adhesive.

3. An engine casing as claimed in claim 1 in which the at least one slot is radially inclined.

4. An engine casing enclosing a rotor, the casing comprising a wall having an inner surface adjacent the rotor, at least a portion of the inner surface of the wall having at least one slot therein, the at least one slot being located radially outward of the inner surface of the wall, an abradable lining being attached to the inner surface of the wall, the abradable lining being located radially inside of the inner surface of the wall, the abradable lining being fluid permeable and extending over the slot and where the abradable lining is a cellular structure.

5. An engine casing as claimed in claim 4 in which a plurality of slots are provided in the inner surface of the wall.

6. An engine casing as claimed in claim 5 in which the slots are equi-spaced in the inner surface of the wall.

7. An engine casing enclosing a rotor, the casing comprising a wall having an inner surface adjacent the rotor, at least a portion of the inner surface of the wall having at least one slot therein, the at least one slot being radially outward of the inner surface of the wall, an abradable lining being attached to the inner surface of the wall, the abradable lining being radially inward of the inner surface of the wall, the abradable lining being fluid permeable and extending across the slot, the slots provided are in the inner surface of the wall, the abradable lining is a cellular structure, in which the cellular structure between the slots is blocked to prevent the passage of the fluid therethrough.

8. An engine casing as claimed in claim 7 in which adhesive blocks the cellular structure between the slots.

* * * * *